US006899224B2

(12) United States Patent
Sheffield et al.

(10) Patent No.: US 6,899,224 B2
(45) Date of Patent: May 31, 2005

(54) SPORTS BALL HOLDER FOR USE IN VEHICLES

(76) Inventors: William J. Sheffield, 509th Sig Bn CMR 427, Box 2529, APO (AE), 09630; Kelly A. Sheffield, 509th Sig Bn CMR 427, Box 2529, APO (AE), 09630

( * ) Notice: Subject to any disclaimer, the term of this patent is extended or adjusted under 35 U.S.C. 154(b) by 162 days.

(21) Appl. No.: 10/320,530

(22) Filed: Dec. 17, 2002

(65) Prior Publication Data

US 2003/0183543 A1 Oct. 2, 2003

Related U.S. Application Data

(60) Provisional application No. 60/367,216, filed on Mar. 26, 2002.

(51) Int. Cl.[7] ..... B65D 85/00

(52) U.S. Cl. ..... 206/315.9; 206/562; 206/563; 206/564

(58) Field of Search ..... 206/315.9, 315.91, 206/495, 557, 560, 564, 562, 563; 224/919, 0.5, 42.11, 42.32, 42.33, 42.38, 42.39; 211/14; 248/346.03; D3/257, 904

(56) References Cited

U.S. PATENT DOCUMENTS

| | | | | | |
|---|---|---|---|---|---|
| 3,311,276 | A | * | 3/1967 | Fromm | 224/42.11 |
| 3,513,969 | A | | 5/1970 | Roff | |
| 3,800,939 | A | | 4/1974 | Cornelius | |
| 3,968,875 | A | * | 7/1976 | Koehnle | 206/315.9 |
| 4,103,773 | A | | 8/1978 | Haber | |
| 4,687,096 | A | * | 8/1987 | Mansur | 206/315.9 |
| 4,732,274 | A | * | 3/1988 | Bouton | 206/561 |
| 4,754,883 | A | | 7/1988 | Grzywa | |
| 4,779,726 | A | | 10/1988 | Pratt | |
| 4,821,931 | A | | 4/1989 | Johnson | |
| 4,838,745 | A | | 6/1989 | Haydock | |
| 4,842,134 | A | * | 6/1989 | Chang | 206/315.9 |
| 5,025,964 | A | | 6/1991 | Phirippidis | |
| 5,065,922 | A | | 11/1991 | Harris | |
| 5,386,906 | A | | 2/1995 | Lai | |
| 5,462,328 | A | | 10/1995 | Chandler et al. | |
| 5,695,056 | A | | 12/1997 | Bender et al. | |
| D403,031 | S | * | 12/1998 | Stousland et al. | D21/627 |
| 6,036,010 | A | | 3/2000 | Seyffert et al. | |
| D434,650 | S | | 12/2000 | Humphrey | |
| 6,199,692 | B1 | | 3/2001 | Van Ness et al. | |
| 6,238,260 | B1 | * | 5/2001 | Spindell | 211/14 |
| 6,405,869 | B1 | * | 6/2002 | Whittemore et al. | 206/497 |
| 2001/0019072 | A1 | | 9/2001 | Wu | |

* cited by examiner

*Primary Examiner*—Mickey Yu
*Assistant Examiner*—J. Gregory Pickett
(74) *Attorney, Agent, or Firm*—Richard C. Litman

(57) ABSTRACT

A sports ball holder holds a ball (e. g., soccer ball, football, volleyball, basketball, etc.) securely therein to preclude ball movement within a vehicle interior while the vehicle is in motion. The holder has a generally square platform, with a support foot extending from each corner. The support feet preferably include a high grip texture or material thereon, to provide a non-slip grip upon the underlying surface. The upper surface of the holder has a receptacle therein, configured and dimensioned to closely fit a relatively large diameter sports ball e. g., basketball). The receptacle bottom may include an additional gripping surface. A secondary tray conforming to the exterior contours of the base, may be placed atop the base to hold a smaller diameter ball (e. g., volleyball, softball, etc.). A net or pouch may be removably secured to the base to hold personal articles for sports players during play.

18 Claims, 3 Drawing Sheets

SPORTS BALL HOLDER FOR USE IN VEHICLES

CROSS-REFERENCE TO RELATED APPLICATION

This application claims the benefit of U.S. Provisional Patent Application Ser. No. 60/367,216, filed Mar. 26, 2002.

BACKGROUND OF THE INVENTION

1. Field of the Invention

The present invention relates generally to devices and containers for holding and restraining various articles, and more particularly to a portable device for securing a sports ball or similar round or spherical object. The present sports ball holder is configured for placement on the floor of a motor vehicle or the like, and includes a generally hemispherical or otherwise appropriately shaped depression for holding a ball or other round object therein. An optional strap may be added to the device, to provide more secure retention of the sports ball therein. The present sports ball holder prevents movement of the ball during travel of the vehicle, and assures convenient access to the ball when desired.

2. Description of Related Art

So-called "stick and ball" sports and games are popular activities not only for school children, but for many adults as well. Such games include soccer, American and Canadian football, volleyball, baseball and softball, and other activities where a round or spherical ball is employed during play of the game.

Obviously, sports equipment, including the game balls, must be transported to and from the playing field whenever a game is scheduled. Conventionally, the sports equipment is tossed loosely in the back of the vehicle (trunk of a car, back of a station wagon or van, etc.), or perhaps placed in a sack or similar container along with any other gear or equipment that might be needed. Most of the equipment used, including uniforms, pads, etc. for individual players, is irregularly shaped, and does not tend to roll around within the vehicle during transport. However, the game balls typically used in such activities are a different matter.

Oftentimes, a relatively large vehicle (e.g., passenger van, station wagon, etc.) is used to transport team members for organized sports, particularly at the youth league level of play. In fact, the use of passenger vans for such purposes has become so common that it has led to the incorporation of the phrases "soccer van" and "soccer mom" in current American English usage. Equipment is often tossed loosely in the back of the vehicle, where the game ball is free to roll around during travel.

This often results in some inconvenience when the destination is reached, as the ball has often rolled around to become lodged beneath a passenger seat, or has otherwise moved to some difficult to access location. This is inconvenient enough during travel to the game when the ball is clean, but is all the more bothersome after the game, when the ball is soiled after perhaps a few hours of play and rolls around the vehicle interior, tracking dirt and grime on the vehicle floor as it rolls.

While this may be viewed as no more than an inconvenience with larger game balls (e.g., soccer, volleyball, etc.), with smaller balls (e.g., baseball, softball, tennis, etc.) such free movement of the game ball during vehicle travel can be potentially hazardous, as the ball may roll forward to interfere with the driver's operation of the pedals. If such occurs, the result is far more than merely inconvenient, and can potentially be tragic.

Accordingly, a need will be seen for a sports ball holder for placement within a motor vehicle, for securing a sports or game ball immovably within the holder to preclude movement of the ball within the vehicle during vehicle travel. The present sports ball holder comprises a stable, multiple legged stand having a generally hemispherical or round depression in the upper center thereof. The ends of the legs may be provided with a non-skid texture or material to preclude movement of the holder. The sports ball is placed within the upper central depression, where it remains securely seated during vehicle travel. Additional accessories may be provided, such as an insert for smaller balls (e.g., baseballs, tennis balls, etc.) or irregularly shaped balls (e.g., American and Canadian footballs, rugby balls, etc.), a net or pouch attachment for holding personal items (e.g., keys, watch, etc.) which the player does not wish to carry during play of the game, and/or a retaining strap to provide additional security for the game ball being held within the device.

A discussion of the related art of which the present inventors are aware, and its differences and distinctions from the present invention, is provided below.

U.S. Pat. No. 3,513,969 issued on May 26, 1970 to Jack H. Roff, titled "Bumper Jack Container Assembly," describes a low and wide container with a lid closure, for securing the various components required for tire removal and replacement on a vehicle. The interior of the Roff device is fitted to hold each of the specifically shaped components (jack base, jack column, jack handle and lug wrench, and bumper shoe) immovably in place. No space is provided for securing a relatively large sports ball, and the relatively low, flat configuration with its lid closure precludes placement of such a ball therein.

U.S. Pat. No. 3,800,939 issued on Apr. 3, 1974 to Victor W. Cornelius, titled "Removable Vehicle Tray," describes a small, generally rectangular, open container for holding one or more drink containers, i.e., a "cup holder." The Cornelius device includes hook and loop pile material disposed on the bottom surface thereof, which engages complementary material adhesively secured to the vehicle seat or dash (not the floor). The small size of the Cornelius container, its cooperating adhesively attached fastening material, and teaching away from the mounting of such a device to the vehicle floor, result in a device which is structurally and functionally dissimilar to the present ball holder.

U.S. Pat. No. 4,103,773 issued on Aug. 1, 1978 to Terry M. Haber, titled "Combination Package And Rack For Cue Balls," describes a double level container for holding two vertically stacked layers of pool balls therein, with a cover overlay. Each level includes a plurality of holes (not depressions) therein, for securing a number of pool balls therein. The second level is also configured for use as a rack, for positioning the conventional fifteen pool balls in a triangular array. No means is provided for securing the device to an underlying surface, and in fact the use of a portion of the device as a rack, teaches away from such securing of the device to an underlying surface, whereas securing to an underlying surface is desirable in the environment of the present sports ball holder invention.

U.S. Pat. No. 4,754,883 issued on Jul. 5, 1988 to Jeffrey W. Grzywa, titled "Automobile Trunk Organizer," describes a "caddy" type tray having a series of receptacles formed therein for holding a number of different articles (cans, containers, small tools and rags, etc.). Grzywa provides some form of mating floor attachment permanently secured thereto, along with attachments disposed along the bottom surface of his device. Also, Grzywa does not provide a single, hemispherical depression in his container for holding a relatively large sports ball, as provided by the present invention.

U.S. Pat. No. 4,779,726 issued on Oct. 25, 1988 to Mykl S. Pratt, titled "Packaging," describes a flat panel having a series of cutouts and flaps for configuring the device to fit about a spherical object. Two of the panels have semicircular cutouts which are opposed when they face one another, and form diagonal members in a box-like structure for holding a ball therein. While the Pratt container securely holds a ball therein, it must be disassembled or opened to install and remove the ball therefrom. No means is provided for holding different size balls.

U.S. Pat. No. 4,821,931 issued on Apr. 18, 1989 to Richard E. Johnson, titled "Multipurpose Article Holding Tray," describes a double stacked assembly having a lower portion which positively but removably secures to the vehicle interior structure, and an upper portion which nests in the top of the lower portion. A plate is permanently secured to the vehicle interior structure, for removably securing the lower portion of the assembly thereto. The lower portion has a series of slots therein, for holding cassette tapes or the like. The upper portion is configured similarly to the trunk organizer of the Grzywa '883 U.S. patent discussed further above, with no means for nesting a sports ball in a hemispherical receptacle being provided by Johnson.

U.S. Pat. No. 4,838,745 issued on Jun. 13, 1989 to Joseph P. Haydock, titled "Trunk Organizer," describes an assembly of stick-like components, each formed of a resilient material and coated with a rubberized surface and/or having one material of cooperating hook and loop material disposed on the surface(s) thereof. The components may be arranged as desired to secure oddly shaped articles in the trunk of a vehicle. No single holder having a hemispherical receptacle for holding a sports ball, is disclosed.

U.S. Pat. No. 5,025,964 issued on Jun. 25, 1991 to George A. Phirippidis, titled "Universal Modular Catalog And Samples Organizer For Vehicles," describes a series of embodiments of generally rectangular partitioned boxes which essentially fill the entire trunk space of a vehicle. No smaller holder providing a hemispherical receptacle for a ball or the like, is disclosed.

U.S. Pat. No. 5,065,922 issued on Nov. 19, 1991 to Charles C. Harris, titled "Container Holding System," describes a series of container embodiments, each of which includes a series of patches of hook elements of hook and loop fastening material for securing to a pile floor carpeting material or similar material. The embodiment most closely related to the present invention, comprises a rectangular open container which may be removably secured to a shelf within the vehicle. Another embodiment comprises a double nesting container which sandwiches the lower edge of an inverted closure bag therebetween, for the carriage of floral arrangements and the like. None of the embodiments is suitable for carrying or holding a sports ball therein.

U.S. Pat. No. 5,386,906 issued on Feb. 7, 1995 to Shihnan Lai, titled "Ball Holder," describes an assembly comprising a pair of ring-like end components which are secured about opposite sides of a ball by a string or the like which is strung back and forth between the two end components to secure them to the ball. One of the end components may carry an inflation tool, if so desired. No means is provided for securing the Lai holder to another object (vehicle floor, etc.), and the rounded external contours of the ball extend between the ring-like components. Thus, the Lai ball holder would have little resistance to rolling around within the interior of a vehicle while the vehicle is in motion. Also, while Lai provides external attachment for an inflation tool or the like, he does not provide any additional storage net or pouch for loose articles.

U.S. Pat. No. 5,462,328 issued on Oct. 31, 1995 to Ricky D. Chandler et al., titled "Ball Carrier Apparatus," describes a tubular device which completely encloses a number of balls therein. A rack extends from the ends of the tube, with the rack having clips for holding baseball bats or the like therefrom. The entire apparatus is adapted to secure to a vertical surface (fence, etc.). The Chandler et al. device cannot be adapted for placement upon a vehicle floor, for securing a sports ball in the top thereof where it is readily accessible without opening the container.

U.S. Pat. No. 5,695,056 issued on Dec. 9, 1997 to Anthony J. Bender et al., titled "Ball Package," describes a display container comprising an upper and a lower portion folded from flat sheet material. The two portions sandwich a ball therebetween, and are secured together by four columns and corresponding plastic screws or other fasteners. While the Bender et al. container certainly keeps a ball contained therein from rolling around, the container must be disassembled each time it is desired to remove the ball therefrom. No open, hemispherical receptacle for placing a ball therein, is provided by Bender et al.

U.S. Pat. No. 6,036,010 issued on Mar. 14, 2000 to Ryan Seyffert et al., titled "Game Ball Display Box And Method For Assembling Same," describes a generally cubical container having circular openings in each face. The opposite end faces are tucked in around a ball placed therein, to secure the ball in place. As in the case of the Bender et al. container, the Seyffert et al. container must be opened to access a ball placed therein.

U.S. Pat. No. 6,199,692 issued on Mar. 13, 2001 to William Van Ness et al., titled "Reduced Material Box Design For Round Objects," describes a rectangular box having round openings in opposite sides thereof, through which a ball contained therein protrudes. The Van Ness et al. container thus more closely resembles the containers of the Bender et al. '056 and Seyffert et al. '010 U.S. patents, than it does the present ball holder.

U.S. Patent Publication No. 2001/19,072 published on Sep. 6, 2001 to Charles Wu, titled "Sheet Or Tissue Dispenser Box Holder For Clinic, Vehicle, Factory, Or Household Applications," describes a flaccid net which may be extended around an object (e.g., rectangular tissue dispensing box) to hold the object. The "bag shaped container" (per the Wu abstract) cannot provide a flat surface or rigid corners when wrapped around a ball, to prevent the ball from rolling, as provided by the present ball holder.

Finally, U.S. Pat. No. D-434,650 issued on Dec. 5, 2000 to Neall W. Humphrey, titled "Package," illustrates a design comprising a rectangular box having opposite open ends and circular openings in the top and bottom thereof. The Humphrey package design more closely resembles the rectangular ball holder box of the Van Ness '692 U.S. patent, than it does the present sports ball holder invention.

None of the above inventions and patents, taken either singly or in combination, is seen to describe the instant invention as claimed.

SUMMARY OF THE INVENTION

The present invention is a sports ball holder for use in motor vehicles, to retain a sports ball (e.g., soccer ball, volleyball, basketball, etc.) in a single location and to prevent the ball from rolling around the vehicle interior where it may inconvenience the vehicle operator or occupants or create a hazard. The present sports ball holder generally comprises a stand having a generally rectangular planform with a short support leg or foot extending from each of the corners thereof. Each foot may include some means for precluding sliding of the device across the underlying surface, e.g., a roughened surface, the hook material of hook and loop fastening material, etc. The upper surface of the ball holder comprises a flat, planar panel having a central, generally hemispherical ball holder receptacle or depression formed therein. A small net or pouch may be secured to one side of the device, to contain personal articles while the occupants of the vehicle are engaged in a game. Different ball sizes and shapes are accommodated by the present ball holder, by means of an adapter tray which may be placed atop the base and which has a smaller ball receptacle therein, for holding a smaller diameter ball. A strap may be provided to secure a ball positively within the device.

The present sports ball holder may be placed at any convenient location in the vehicle (e.g., on the cargo floor in a van or station wagon, etc.), and the sports ball placed therein. The ball cannot roll through the interior due to its nesting within the ball holding receptacle of the holder, and the holder cannot move across the vehicle floor due to the gripping means provided.

Accordingly, it is a principal object of the invention to provide a sports ball holder for use in a motor vehicle, to preclude movement of a ball contained therein through the interior of the vehicle while the vehicle is in motion.

It is another object of the invention to provide such a sports ball holder having a generally rectangular planform with a flat upper surface, the upper surface including a ball holding receptacle formed therein.

It is a further object of the invention to provide such a sports ball holder including a foot extending from each corner thereof, with each foot including means for gripping the underlying surface.

Still another object of the invention is to provide such a sports ball holder having a secondary tray which may be placed atop the base, for holding a ball smaller than the diameter of the ball receptacle of the base component.

An additional object of the invention is to provide such a sports ball holder including a pouch or net secured thereto for holding personal articles therein, and/or a ball retaining strap providing positive retention of a sports ball placed therein.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
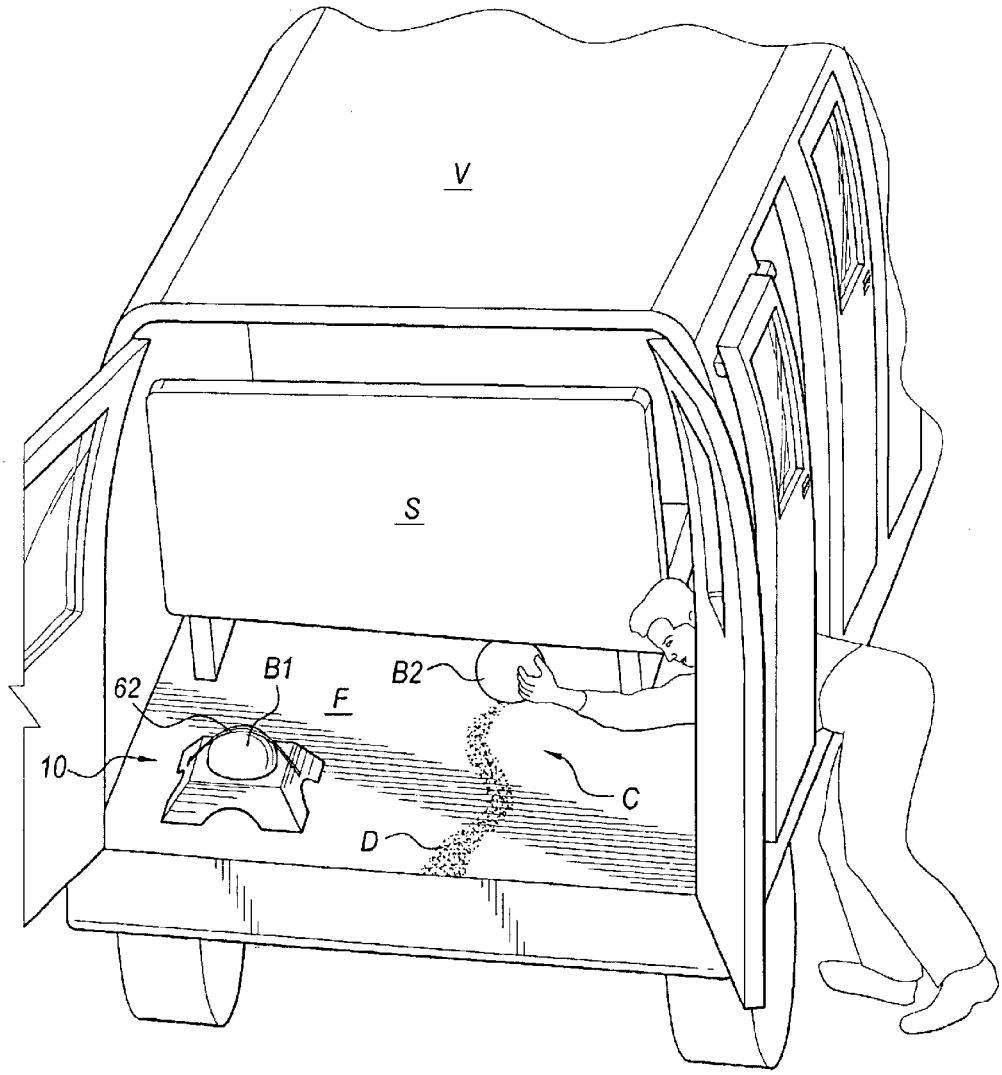
FIG. 1 is an environmental, perspective view of a sports ball holder for use in vehicles according to the present invention, also illustrating prior art problems with ball carriage in vehicles.

The present invention is a portable sports ball holder for removable placement within a vehicle, and serves to prevent a sports ball from rolling about the interior of the vehicle during travel. FIG. 1 of the drawings discloses an exemplary illustration of the present sports ball holder 10 which has been placed on the floor F of the cargo area C of a vehicle V, and shows the general configuration of the present sports ball holder 10 as well as the problems encountered when the present sports ball holder is not used to retain a sports ball within a vehicle. The sports ball holder 10 serves to hold a sports ball B1 securely therein, and precludes movement of the ball around the vehicle interior, as indicated by the second sports ball B2 shown in FIG. 1.

Figure 2:
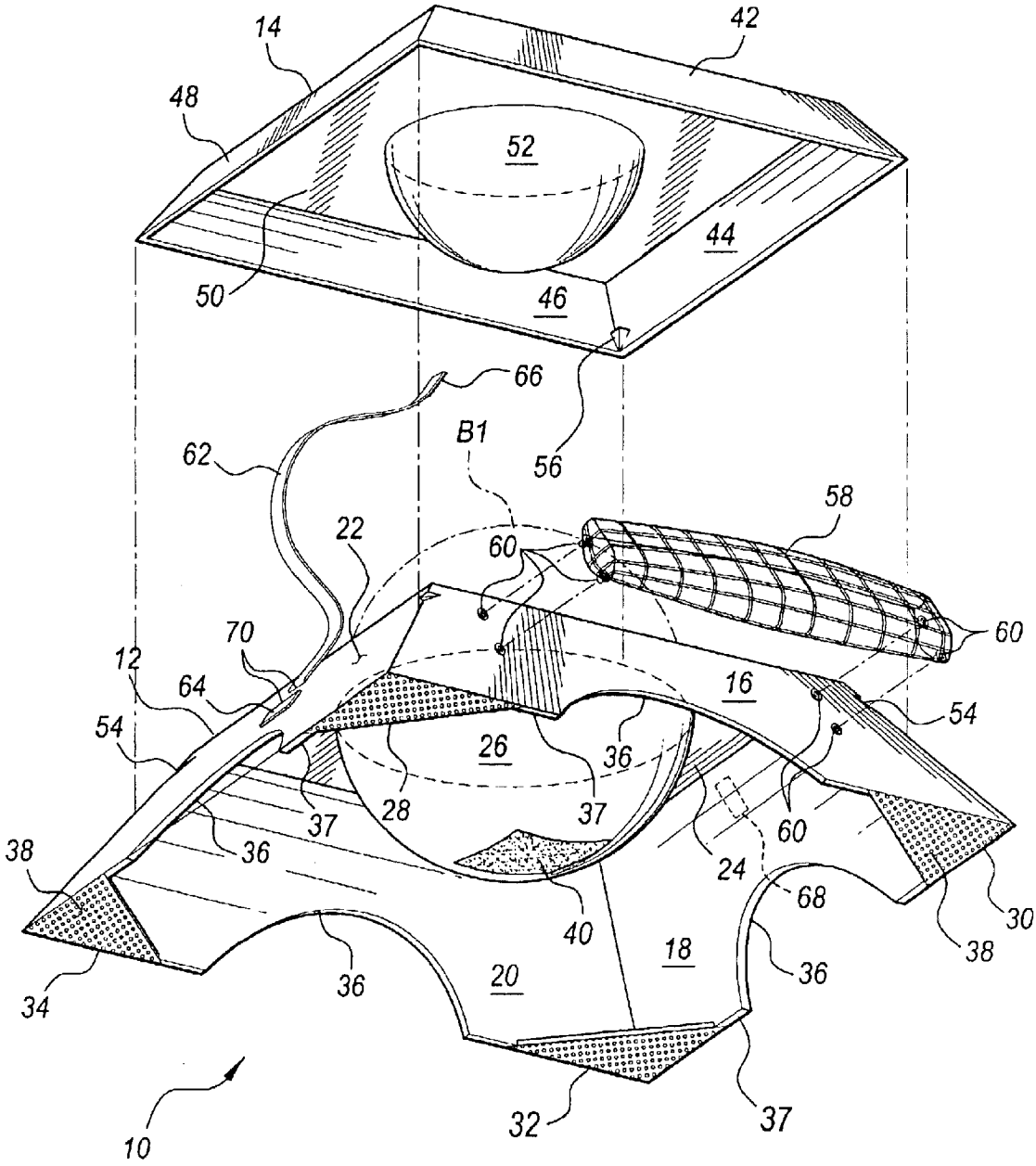
FIG. 2 is an exploded, bottom perspective detail view of the present sports ball holder, showing means for securing the device to an underlying surface and additional components therewith.

FIG. 2 of the drawings provides a detailed perspective view of the present sports ball holder 10, showing various details of the base component 12 and a secondary tray 14 which may be removably secured to the top of the base 12. The base 12 has the general shape or configuration of a truncated pyramid, with four upwardly and inwardly tapering sides 16, 18, 20, and 22 terminating in an upper panel 24. The upper panel 24 has a flat, planar periphery, with a central receptacle 26 formed therein, as shown clearly in FIG. 3 of the drawings.

The sports ball holding receptacle 26 is configured to hold a sports ball B1 (or other ball) securely therein, as shown in FIG. 1 of the drawings. The sports ball holding receptacle 26 may be dimensioned and configured to hold virtually any size or type of conventional spherical or non-spherical sports ball as desired Preferably, the ball holder receptacle 26 is dimensioned and configured to have a generally hemispherical shape having a diameter sufficient for holding substantially half of a relatively large sports ball (e.g., basketball, etc.) closely therein. Smaller sports balls may be secured in the present holder 10 by means of the secondary tray 14 which may be removably installed atop the base 12, as discussed further below. Alternatively, the ball holder receptacle 26 of the base component 12 may be configured to hold a ball having a somewhat smaller diameter than a basketball, if so desired, or may be configured to have a shape other than hemispherical, for holding a non-spherical sports ball (e.g., American or Canadian football, rugby ball, etc.).

Each of the four sides 16 through 22 joins with two adjacent sides, with a support foot, respectively 28 through 34, depending from the base 12 and extending across the intersecting corners of the sides 16 through 22. The sides 16 through 22 may each include an arcuate relief area 36 along the lower edges 37 and between each of the ends thereof, which may serve as hand holds to enable a person using the ball holder 10 to extend the hand thereunder and grip the holder 10 for removal from the vehicle, etc.

The support feet 28 through 34 comprise a series of plates which are parallel to the planar peripheral area of the upper surface or panel 24, and extend diagonally across the corners of adjacent sides. Each of the feet 28 through 34 preferably includes some form of high coefficient of friction gripping means 38 disposed thereon, e.g., a roughened or textured surface to engage the conventional carpeting found on most vehicle floors, or perhaps the hook material of hook and loop fabric attachment material, which is well adapted to engage the typical pile material of which most vehicle carpets are formed.

In addition to the gripping means 38 disposed on the bottoms of the support foot pads 28 through 34, the bottom surface of the center portion of the sports ball receptacle may be positioned to be essentially coplanar with the four support feet 28 through 34, and an additional gripping surface or means 40 (roughened surface, hook and loop fabric material, etc.) may be disposed thereon, as shown in FIG. 2, for further assurance that the present sports ball holder 10 will not move or slide in the vehicle V while under way.

In the event that a sports ball somewhat smaller and/or differently shaped than the relatively large diameter ball B1 is to be secured, a secondary ball holding tray 14 may be removably secured to the top of the base portion 12, if so desired. The secondary tray 14 has a configuration much like that of the base 12, i.e., a low, flat, truncated pyramid having four upwardly and inwardly tapering sides, respectively 42, 44, 46, and 48, with a top panel 50 extending thereacross. The lateral dimensions of the secondary tray 14 are such that the sides 42 through 48 and top panel 50 of the tray 14 fit closely against the sides 16 through 22 and top panel 24 of the underlying base 12, and the relatively smaller hemispherically configured ball holding receptacle 52 of the secondary tray 14 fits within the larger ball receptacle 26 of the underlying base 12 when the secondary tray 14 is removably installed thereon, as shown clearly in FIG. 3 of the drawings.

The secondary tray 14 may be positively secured to the base 12 by a series of cooperating fittings disposed upon the base 12 and tray 14. The base 12 includes a recess or catch 54 formed in each corner thereof, with the secondary tray 14 having a series of inwardly disposed fingers or tabs 56 (one of which is illustrated in FIG. 2). The tabs or fingers 56 of the secondary tray 14 engage the recesses or catches 54 of the base 12 when the secondary tray 14 is pushed downwardly thereon to seat the tray 14 on the base 12. Removal of the tray 14 from the base 12 is easily accomplished by flexing the tray 14 and base 12 slightly relative to one another, to disengage one or more of the tabs 56 and catches 54.

Figure 3:
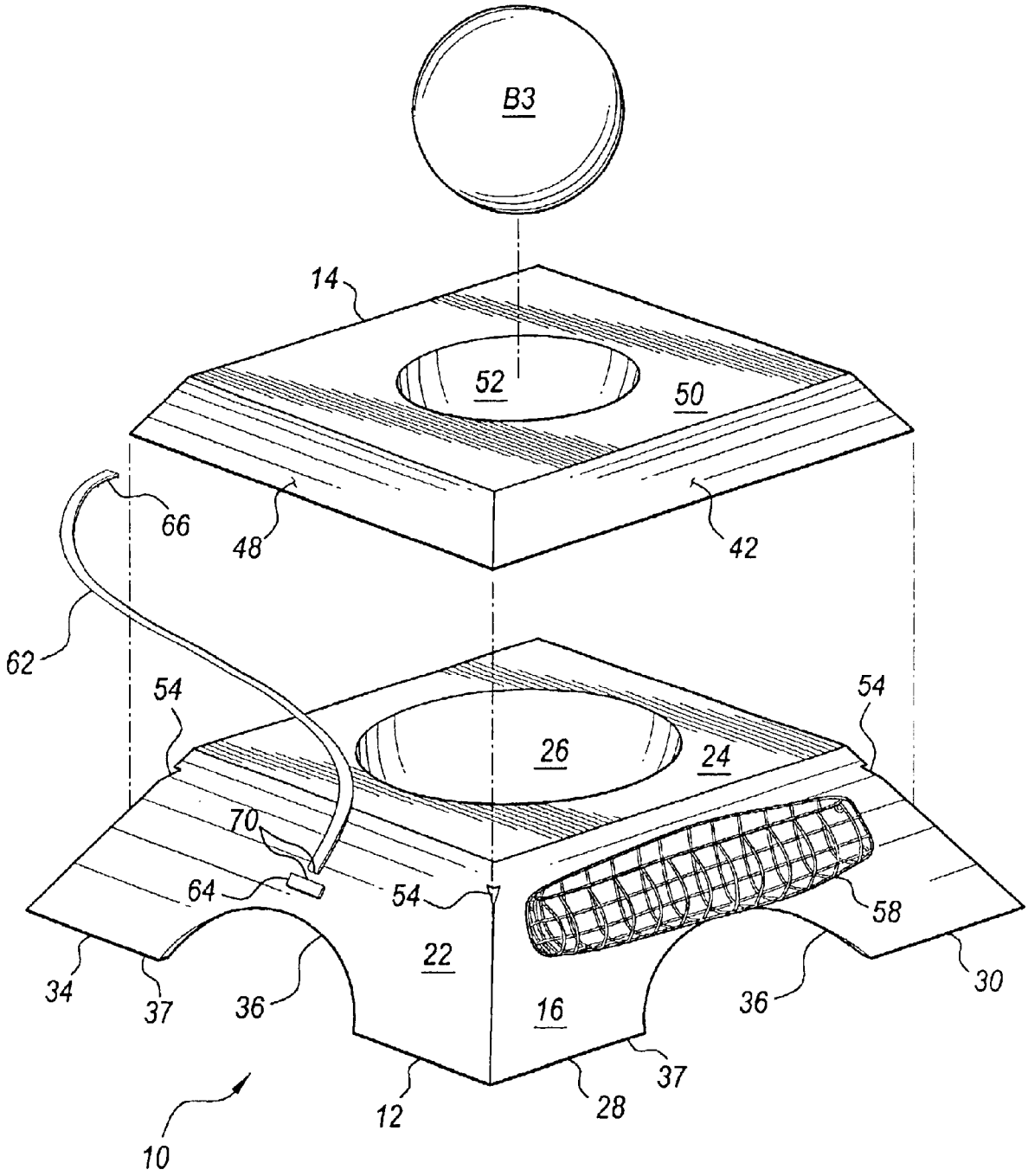
FIG. 3 is an exploded, top perspective detail view of the present sports ball holder, showing further details of the components illustrated in FIG. 2.

Another embodiment of the present sports ball holder may include some means for securing personal possessions or the like therewith, when persons are engaged in a game and do not wish to carry such articles (watches, wallets, keys, etc.) with them during play. FIGS. 2 and 3 illustrate such a device, comprising a relatively small cargo net or storage pouch 58 which may be secured to one of the sides of the base 12. (Obviously, such a pouch or net 58 may be secured to more than one side of the base 12, if so desired.) The pouch or net 58 is preferably removably secured to the side of the base 12, e.g. using mating snap fastener components 60 or other suitable retaining means which allow the pouch 58 to be removed from the base 12 as desired.

FIG. 3 of the drawings provides a top perspective view of the present sports ball holder assembly 10, showing the smaller ball receptacle 52 of the secondary tray 14. As the smaller receptacle 52 fits within the larger ball receptacle 26 of the underlying base 12, there is no interference between the two receptacles 26 and 52. As in the case of the larger receptacle 26 of the base 12, the smaller receptacle 52 has a generally hemispherical configuration, to hold substantially one half of a spherical ball B3 therein. The smaller ball B3 may be a volleyball, softball, baseball, etc., with the smaller ball holder receptacle 52 of the secondary tray 14 dimensioned and configured for that particular ball size. Alternatively, either of the ball receptacles 26 and 52 may have other than hemispherical configurations, to fit non-spherical sports balls (e.g., footballs, rugby balls, etc.).

Additional security may be provided for a sports ball contained within the present holder 10, by means of a flexible retaining strap 62. The strap 62 includes a captured end having a relatively wide extension 64 thereacross, generally forming the crossmember of a "T" configuration. The opposite end of the strap 62 includes removable attachment means 66 thereon (e.g., hook and loop material, etc.), which secures to a mating material 68 permanently secured to one of the sides (e.g., side 18 in FIG. 2) of the device. The strap 62 passes through a double slot 70 on the opposite side (e.g., the side 22 in FIGS. 2 and 3), and is captured therein when the wider "T" crossmember end 64 reaches the relatively narrower double slot 70.

The strap 62 may be used to provide additional security for a sports ball placed within the device, and in fact may preclude the need for the supplementary tray 14 illustrated in FIGS. 2 and 3. When a sports ball is placed within the base receptacle 26, the strap 62 is passed over the top of the ball. The attachment material 66 on the free end of the strap 62 is removably secured to the mating material 68 on the opposite side of the device, to hold the ball securely and positively in place.

In conclusion, the present sports ball holder greatly facilitates the carriage and transport of a sports or game ball in a moving vehicle, and further serves to retain such a sports ball in a parked vehicle when the vehicle is on a slope or incline. FIG. 1 of the drawings clearly illustrates this problem, with a loose ball B2 which has become wedged beneath the rear seat S of the vehicle V. The ball B2 has picked up mud and debris from the game, and the ball B2 is free to roll around the interior of the vehicle V and leave a track of such mud and debris D across the vehicle floor F, wherever the ball B2 has occasion to roll. While this may be no more than an annoyance or inconvenience with larger sports balls (e.g., soccer balls, footballs, etc.), smaller sports balls rolling about the interior of a vehicle can easily roll beneath the seats and perhaps roll to the front of the vehicle, where they may become lodged beneath the pedals and/or otherwise interfere with vehicle control. The problem extends beyond a mere annoyance to a major hazard, if such occurs.

The present sports ball holder provides an economical and convenient solution to these problems, and enables a vehicle owner or operator to quickly and conveniently store a sports ball of any practicable type in a secure location where it cannot move about the vehicle during vehicle operation. The present sports ball holder provides great versatility, and is capable of holding and securing virtually any type of spherical or non-spherical game ball, including but not limited to conventional basketballs, soccer balls, volleyballs, footballs, rugby balls, softballs, tennis balls, and baseballs. The present sports ball holder may be economically manufactured of a durable plastic material in any of a vast number of colors and decor as desired, or alternatively other materials may be used as desired. The present sports ball holder will thus find great favor among those who have a need to transport sports equipment of various types in a moving vehicle.

It is to be understood that the present invention is not limited to the embodiments described above, but encompasses any and all embodiments within the scope of the following claims.

We claim:

1. A sports ball holder for use in a vehicle, comprising:

a base;

a plurality of support feet depending from said base;

an upper surface extending across said base;

a sports ball receptacle formed centrally within said upper surface, the receptacle being dimensioned and configured to contain substantially one half of a conventional sports ball therein, and to fit closely about the substantially one half of the conventional sports ball contained therein;

a secondary tray for a smaller ball, removably installed atop said base; and positive retaining means for removably securing said secondary tray to said base.

2. The sports ball holder according to claim 1, wherein:

said base has a substantially truncated pyramidal configuration with four sides;

each of said sides has a lower edge extending between two of said feet; and each said lower edge includes an arcuate relief formed therein.

3. The sports ball holder according to claim 1, wherein:

said secondary tray has a substantially truncated pyramidal configuration with four sides and an upper surface; each of said sides of said secondary tray fitting closely over said base;

a sports ball receptacle formed centrally within said upper surface of said secondary tray; and said sports ball receptacle of said secondary tray being dimensioned and configured to contain substantially one half of a conventional sports ball therein, and to fit closely about the substantially one half of the conventional sports ball contained therein.

4. The sports ball holder according to claim 1, further including:

at least a first side and a second side opposite said first side, extending from said base; and a sports ball securing strap having a captured end secured to said first side, and an opposite distal end removably attached to said second side.

5. The sports ball holder according to claim 1, further including a storage pouch disposed upon said base.

6. The sports ball holder according to claim 5, wherein said storage pouch is removably secured to said base.

7. The sports ball holder according to claim 1, further including gripping means for gripping a surface disposed upon each of said support feet.

8. The sports ball holder according to claim 7, wherein:

said sports ball receptacle has a downwardly facing bottom center portion substantially coplanar with said support feet; and said bottom center portion of said sports ball receptacle further includes gripping means for gripping a surface disposed thereon.

9. A sports ball holder for use in a vehicle and a sports ball therewith, comprising in combination:

a sports ball holder base;

a plurality of support feet depending from said base;

an upper surface extending across said base;

a sports ball receptacle formed centrally within said upper surface of said base; and a sports ball;

wherein said sports ball receptacle is dimensioned and configured to contain substantially one half of said sports ball therein, and to fit closely about the substantially one half of said sports ball contained therein;

said base has a substantially truncated pyramidal configuration with four sides;

each of said sides has a lower edge extending between two of said feet; and each said lower edge includes an arcuate relief formed therein.

10. The sports ball holder and sports ball combination according to claim 9, further including a secondary tray for a smaller ball, removably installed atop said base.

11. The sports ball holder and sports ball combination according to claim 10, wherein:

said secondary tray has a substantially truncated pyramidal configuration with four sides and an upper surface; each of said sides of said secondary tray fitting closely over said base; and a sports ball receptacle formed centrally within said upper surface of said secondary tray, said sports ball receptacle of said secondary tray being dimensioned and configured to contain substantially one half of a conventional sports ball therein, and to fit closely about the substantially one half of the conventional sports ball contained therein.

12. The sports ball holder and sports ball combination according to claim 10, further including positive retaining means for removably securing said secondary tray to said base.

13. The sports ball holder according to claim 9, further including:

at least a first side and a second side opposite said first side, extending from said base; and a sports ball securing strap having a captured end secured to said first side, and an opposite distal end removably attached to said second side.

14. The sports ball holder and sports ball combination according to claim 9, further including a storage pouch disposed upon said base.

15. The sports ball holder and sports ball combination according to claim 14, wherein said storage pouch is removably secured to said base.

16. The sports ball holder and sports ball combination according to claim 9, further including gripping means disposed upon each of said support feet for gripping a surface.

17. The sports ball holder and sports ball combination according to claim 16, wherein:

said sports ball receptacle has a downwardly facing bottom center portion substantially coplanar with said support feet; and said bottom center portion of said sports ball receptacle further includes gripping means disposed thereon for gripping a surface.

18. A sports ball holder for use in a vehicle, comprising:

a base;

a plurality of support feet depending from said base;

an upper surface extending across said base;

a sports ball receptacle formed centrally within said upper surface, the receptacle being dimensioned and configured to contain substantially one half of a conventional sports ball therein, and to fit closely about the substantially one half of the conventional sports ball contained therein; and gripping means for gripping a surface disposed upon each of said support feet;

wherein said sports ball receptacle has a downwardly facing bottom center portion substantially coplanar with said support feet; and said bottom center portion of said sports ball receptacle further includes gripping means for gripping a surface disposed thereon.

* * * * *